United States Patent [19]

Loyd, Jr. et al.

[11] 4,332,389

[45] Jun. 1, 1982

[54] ELECTRONIC BINGO GAME

[75] Inventors: Comer C. Loyd, Jr., 5813 Mackinaw Rd., Houston, Tex. 77053; James D. Benner, Houston, Tex.

[73] Assignee: Comer C. Loyd, Jr., Houston, Tex.

[21] Appl. No.: 162,405

[22] Filed: Jun. 23, 1980

[51] Int. Cl.[3] ..... A63F 3/06

[52] U.S. Cl. ..... 273/237; 273/269; 273/138 A

[58] Field of Search ..... 273/138 A, 139, 237, 273/269; 364/717

[56] References Cited

U.S. PATENT DOCUMENTS

| | | | |
|---|---|---|---|
| 3,653,026 | 3/1972 | Hurley | 273/139 |
| 3,895,807 | 7/1975 | Friedman | 273/138 A |
| 4,080,596 | 3/1978 | Keck et al. | 273/237 |
| 4,121,830 | 10/1978 | Buckley | 273/138 A |
| 4,151,404 | 4/1979 | Harrington et al. | 273/138 A |

OTHER PUBLICATIONS

*Bingo King*, pp. 12–79.

*Primary Examiner*—Vance Y. Hum
*Assistant Examiner*—Leo P. Picard
*Attorney, Agent, or Firm*—Arnold, White & Durkee

[57] ABSTRACT

An electronic bingo game is disclosed in which a memory is provided for storing all of the numbers called in a last set until the current set is completed and the next set begun. A claim to a late bingo game can then be easily verified by recalling the numbers from the last set. A preselectable time interval is provided to determine the rate at which the bingo numbers are called. A true random number selection process is provided to select the bingo numbers called. A randomly selected seed number is provided at the start of each set, and the seed number used in each random selection for that set. Additional memory is included for storing the game patterns that will be used in each set, and each pattern will automatically be called up and displayed to the players as each new set is begun.

7 Claims, 6 Drawing Figures

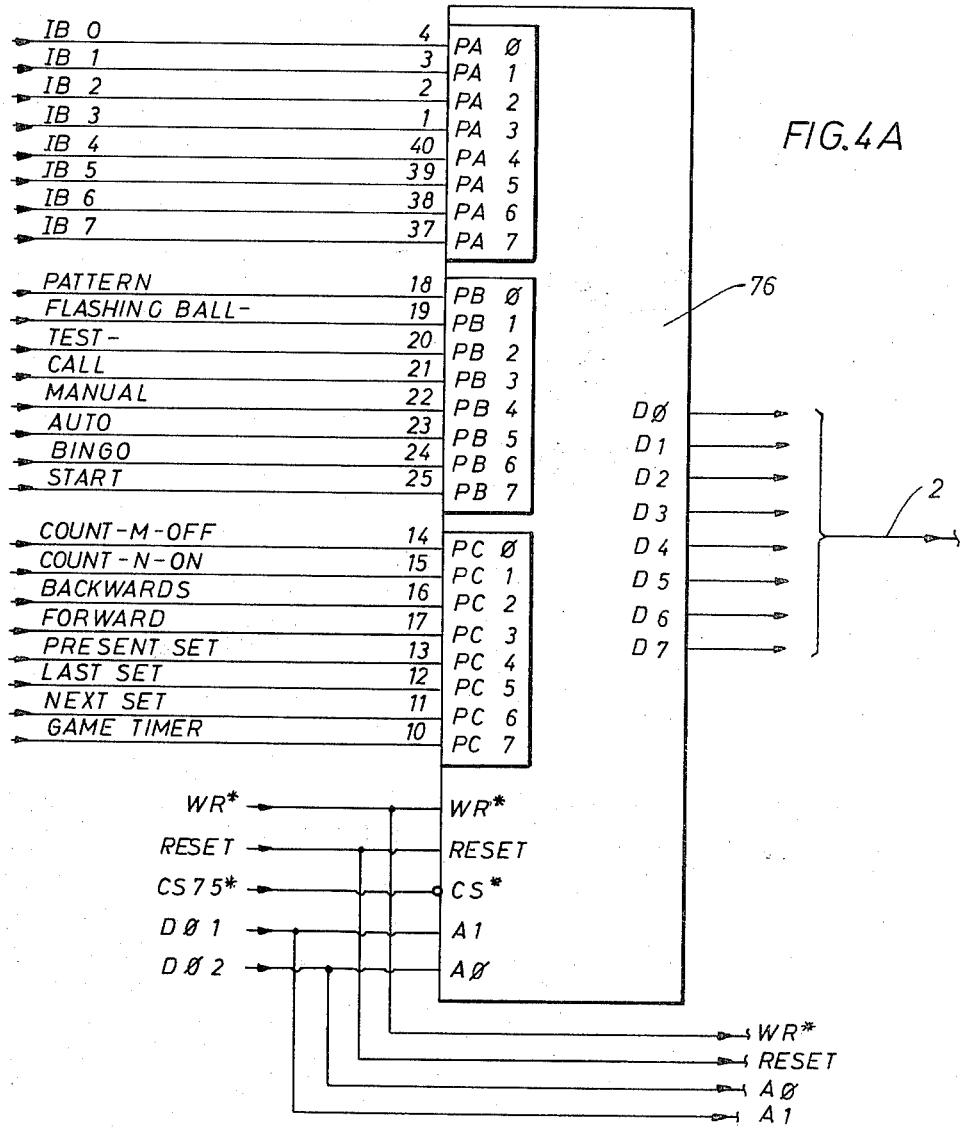
FIG.4A
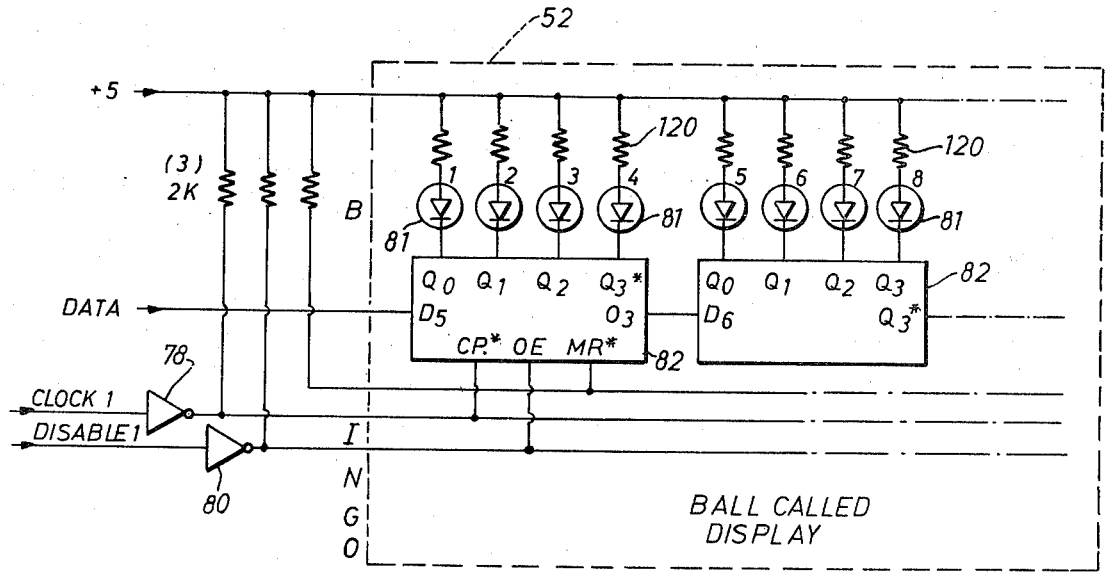

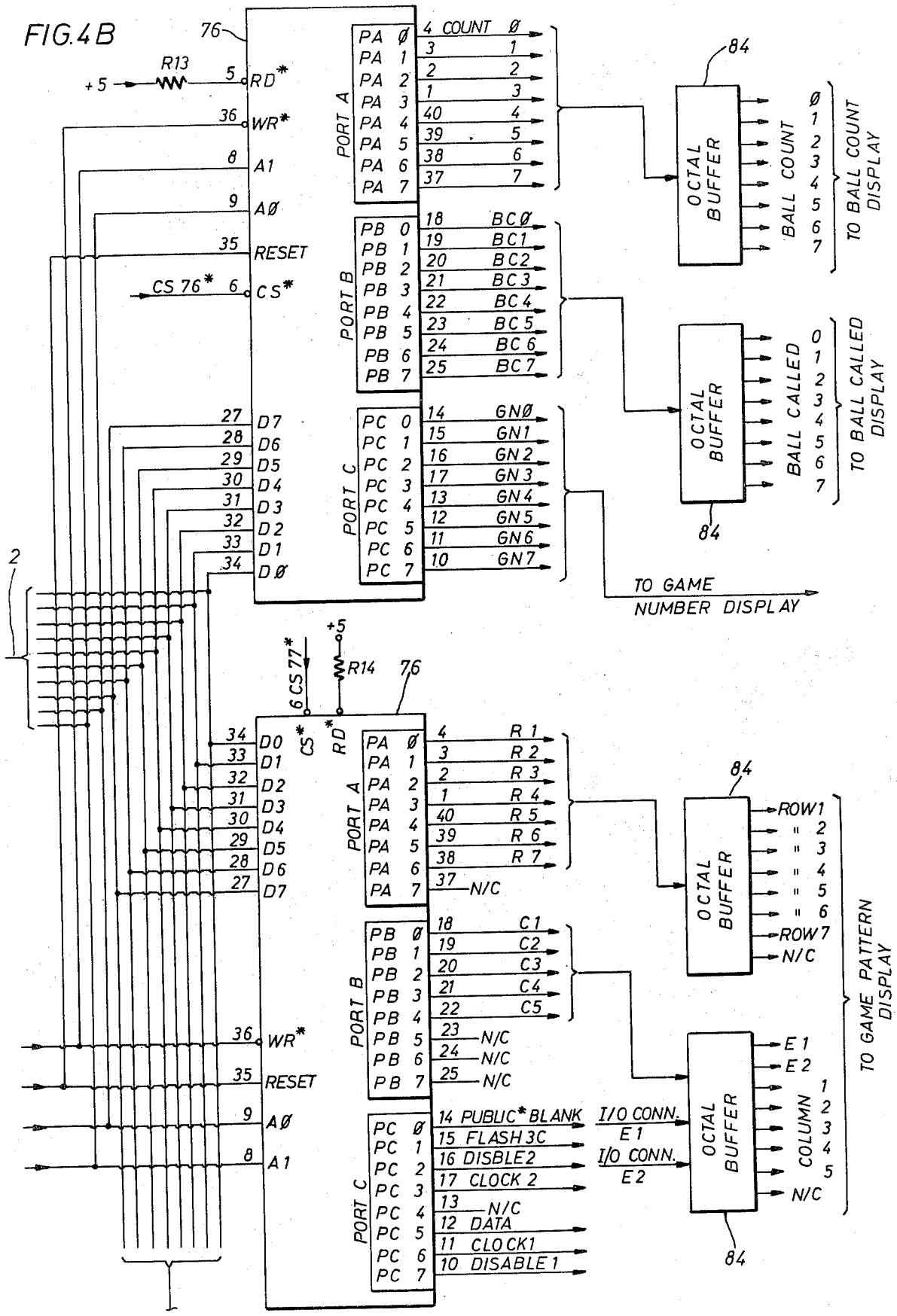
FIG.4B
76
R13
+5
5 RD*
36 WR*
8 A1
9 AØ
35 RESET
CS 76* 6 CS*
27 D7
28 D6
29 D5
30 D4
31 D3
32 D2
33 D1
34 DØ
2
PORT A
PA Ø 4 COUNT Ø
PA 1 3 1
PA 2 2 2
PA 3 1 3
PA 4 40 4
PA 5 39 5
PA 6 38 6
PA 7 37 7
PORT B
PB 0 18 BCØ
PB 1 19 BC1
PB 2 20 BC2
PB 3 21 BC3
PB 4 22 BC4
PB 5 23 BC5
PB 6 24 BC6
PB 7 25 BC7
PORT C
PC 0 14 GNØ
PC 1 15 GN1
PC 2 16 GN2
PC 3 17 GN3
PC 4 13 GN4
PC 5 12 GN5
PC 6 11 GN6
PC 7 10 GN7
84
OCTAL BUFFER
BALL COUNT
Ø 1 2 3 4 5 6 7
TO BALL COUNT DISPLAY
BALL CALLED
0 1 2 3 4 5 6 7
TO BALL CALLED DISPLAY
TO GAME NUMBER DISPLAY
6 CS 77*
+5
R14
76
34 D0
33 D1
32 D2
31 D3
30 D4
29 D5
28 D6
27 D7
CS*
RD*
PORT A
PA Ø 4 R 1
PA 1 3 R 2
PA 2 2 R 3
PA 3 1 R 4
PA 4 40 R 5
PA 5 39 R 6
PA 6 38 R 7
PA 7 37 N/C
PORT B
PB Ø 18 C1
PB 1 19 C2
PB 2 20 C3
PB 3 21 C4
PB 4 22 C5
PB 5 23 N/C
PB 6 24 N/C
PB 7 25 N/C
36 WR*
35 RESET
9 AØ
8 A1
PORT C
PC Ø 14 PUBLIC* BLANK
PC 1 15 FLASH 3C
PC 2 16 DISBLE2
PC 3 17 CLOCK 2
PC 4 13 N/C
PC 5 12 DATA
PC 6 11 CLOCK1
PC 7 10 DISABLE 1
I/O CONN. E1
I/O CONN. E2
84
OCTAL BUFFER
ROW1
2
3
4
5
6
ROW7
N/C
E1
E2
COLUMN
1 2 3 4 5
N/C
TO GAME PATTERN DISPLAY

ELECTRONIC BINGO GAME

BACKGROUND OF THE INVENTION

This invention relates to electronic games, and more particular, this invention relates to an electronic bingo game in which a true random number generation process is used to select each bingo number called, and where the game information from the last set is preserved until the current set is completed and the next set begun.

Prior-art electronic bingo games, such as those disclosed in U.S. Pat. Nos. 3,653,026 to Hurley, 3,895,807 to Friedman, and 4,121,830 to Buckley, disclose various ways to randomly select the next bingo number to be called. Hurley discloses a random number selection process in which the charge level and the value of a capacitor determines a time interval. During this time interval, a sequencer sequences through the bingo numbers and, at the end of the interval, stops on the next number to be called. Friedman discloses a random number selection process in which the $5 \times 15$ bingo matrix of letters and numbers are addressed from a high and a low frequency clock signal. Each matrix position is identified by two addresses. Once selected, each position is thereafter removed from the selection process. Buckley discloses a random number selection system which includes a RAM (Random Access Memory) unit having the bingo numbers stored therein. The RAM address counter is sequenced through its various addresses at a fixed rate unless the current address is of number which has already been called. If already called, that address is immediately indexed to the next address. Random number selection is controlled by the current address when the operator makes a pick.

One of the major problems in these and all prior-art bingo games is the "late bingo." Once a set consisting of a series of games or a single game has been completed by a bingo and a winner verified, a new set is initiated and all of the bingo numbers for that set are cleared. This clearing could consist of returning numbered balls to a bin in the more common type of bingo games or by clearing all the stored addresses or information of bingo numbers called in the newer electronic bingo games. Once the numbers are cleared, a dishonest player may then attempt to claim a "late bingo" since there is no longer any way to accurately determine if he is a legitimate winner. Another problem in prior-art bingo games results from a change in bingo number callers from one set to the next. This problem results because the rate at which a caller selects the bingo numbers will vary from caller to caller.

Accordingly, it would be advantageous to provide a bingo game which could automatically store each bingo number called in the last set until the current set has been completed and the next set initiated so that, if a "late bingo" is claimed, the numbers can be recalled from storage and used to verify if the late bingo player is a true winner. It would also be advantageous to provide a bingo game which selects the bingo numbers at a fixed rate independent of the caller so that the players can become accustomed to the rate of numbers called. Additionally, it would be advantageous to provide an electronic bingo game in which the game patterns for a series of sets are pre-programmed into memory to be automatically recalled and displayed as each new set is started.

SUMMARY OF THE INVENTION

In accordance with the present invention, an electronic bingo game which is played in sets with each set comprising one or more bingo games played as a series of called bingo numbers, and where a winner in each bingo game is determined by completing a predetermined bingo card pattern is disclosed. A variable timer is provided for automatically timing the interval between bingo number selections in each game to give the game players a constant rate of bingo numbers called. A pattern storing means is provided for storing a predetermined number of bingo patterns, with one pattern programmed for each game to be played. As each new game is initiated, the preprogrammed pattern for that game is recalled from storage and displayed to both the operator and the players.

A game counter is provided for counting and displaying the number of games that have thus far been played. Also included is a number counter for counting and displaying the number of bingo numbers that are called in each set. A bingo game may be played in which special prizes are given if a bingo occurs in less than a certain number of balls called. The contents of the number counter is provided with means for flashing on and off the displayed number count when the total number of balls called is equal to the last number that can win the prize. This indicates to the players that if they do not bingo on that called ball, the special prize will not be won.

A means for storing and displaying the bingo numbers that are called in each set is also provided. A memory unit stores the bingo numbers called in both the current set and for the last set including the last ball called and the number of balls called in the last set. In this way, once a new set is initiated, if a late bingo is claimed, the last set numbers can be recalled and used to verify if the late bingo is truly a winner. To select each ball called, a random number generator is provided that responds to the variable timer to initiate a random number generation sequence to select a bingo number, with each number having an equal probability of selection. To insure a truly random number selection for each set, as each set is initiated, a seed number is randomly selected and used in each random number selection for that set. Each set has its own seed number.

In the preferred embodiment of the present invention, a programmed microprocessor is provided to perform the random number generation process, as well as providing the storing means for storing the game patterns and the bingo numbers called in the previous set. If the bingo game operator chooses to control the interval between numbers called, the automatic time interval may be overridden and a manual selection made. A display of the bingo numbers called, the bingo number to be called, the ball count and the game patterns are displayed both the operator and to the players in separate display units.

BRIEF DESCRIPTION OF THE DRAWINGS

An electronic bingo game including a memory for retaining the bingo numbers called from the last set until the current set has been completed and the next set initiated is illustrated in the accompanying drawings in which.

FIGS. 4(A) and (B) with the latter placed to the right of the former, form the circuit diagram of the input/output interface between the microprocessor and the bingo display units.

Similar reference numerals refer to similar elements throughout the several views of the drawings.

DETAILED DESCRIPTION OF THE PREFERRED EMBODIMENTS

Figure 1:
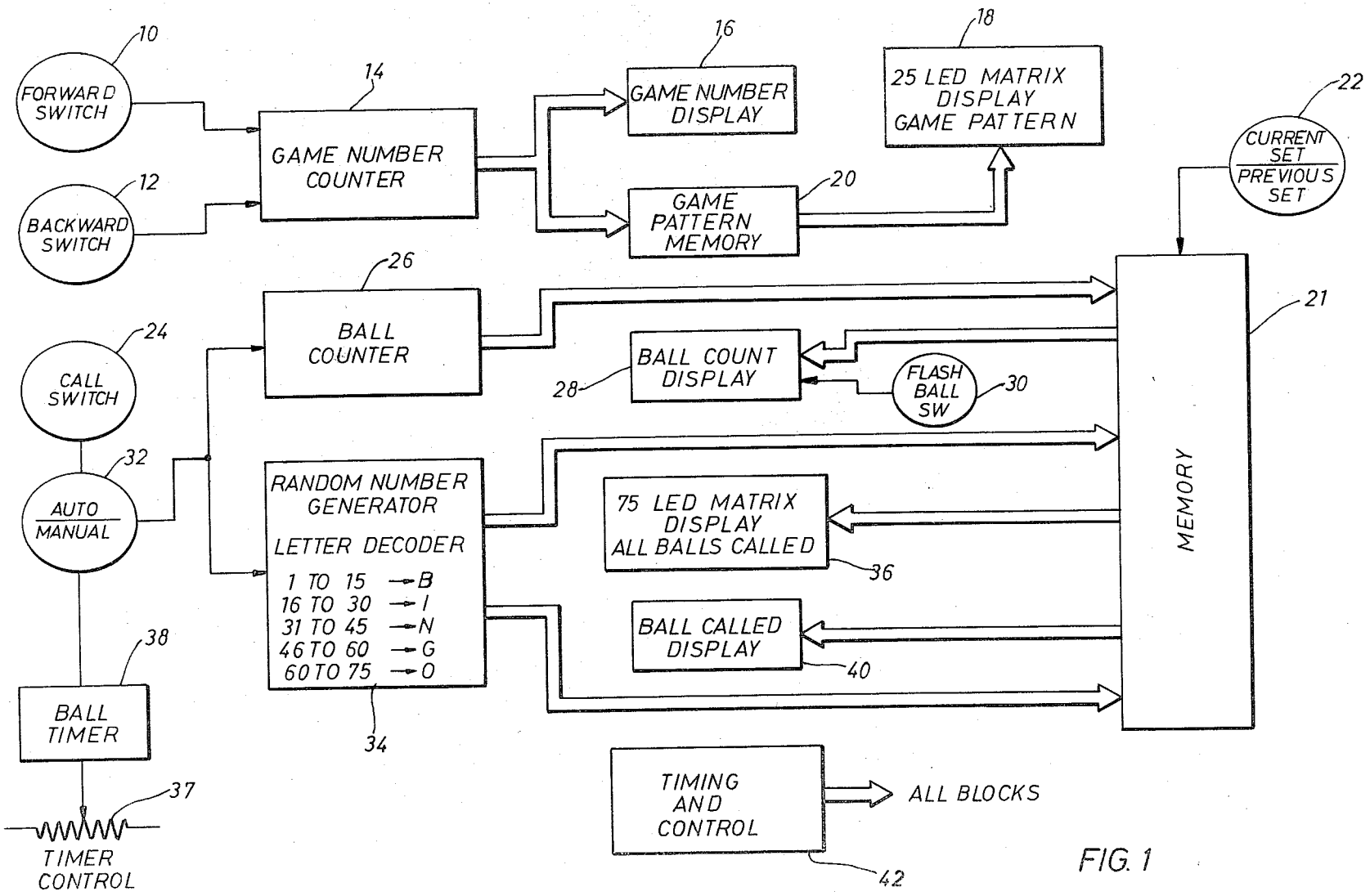
FIG. 1 is a functional block diagram of the present invention.

Referring to the functional block diagram of the present invention illustrated in FIG. 1, a random number generator 34 which randomly selects the next bingo number to be called is shown responding to the ball timer 38. A timer control 37 sets a time interval within the ball timer 38 to determine the rate at which the bingo numbers will be called. An auto/manual switch 32 is provided to override the automatic calling interval to permit the operator to manually select the next bingo number by initiating the call switch 24. The most common type of prior-art bingo games have used numbered balls selected from a bin to represent the bingo numbers called. As used herein, bingo numbers and balls are used interchangably to mean the same thing, i.e., a bingo number. As each bingo number is selected, a ball counter 26 is incremented to keep count of the total number of balls called. In some bingo games, a special prize is awarded to a player that bingos in a number of balls less than or equal to a predetermined number. A means is provided for flashing on and off the ball count display in response to the flash ball switch 30 when the ball count is equal to the predetermined number by which the special prize bingo must occur. The flashing ball indicates to the players that if they don't bingo on that ball, they will not win the special prize.

The random number generator 34 randomly selects a "seed" number at the start of each set, and uses the seed number in the random selection process to insure that the numbers selected from set-to-set do not exhibit any sort of pattern. This insures a truely random number generation. A counter running from a high speed clock is used to produce the seed numbers. When a new set is initiated, the current contents of the counter is selected as the seed number for that set. This seed number is then used in the selection process for each bingo number. Even though a bingo number has been called, that number is not removed from the selection process, but remains as likely to be once again selected as any other number. However, if a number is selected that has already been called, the random number generator 34 repeats its selection process until a number that has not been called is selected.

As each number is selected, it is displayed to both the caller and to the players. Additionally, the selected number is stored in memory unit 21. Each ball that is selected by the random number generator 34 is displayed in the player's ball called display 40 so that the players will have display to them the ball that is currently being called. When a bingo has occurred and the set completed and the next set initiated, the ball count and the last ball called are also stored in memory unit 21 as part of the information from the last set. Because each of the called balls from the last set are stored in memory 21, a late bingo can be verified by recalling and displaying in the matrix display unit 36 the last set of called numbers. The current set/previous set switch 22 controls from which source of information the displays 28, 36 and 40 will obtain the data to be displayed. At the beginning of the next set, the bingo numbers for the just completed current set are transferred to the previous set memory locations so that the bingo numbers for the current set can then be stored in the current set memory locations.

At the beginning of each set, a game number counter 14 is incremented to record the number of sets that have been played. Forward switch 10 and backward switch 12 control the counting direction of the game number counter 14. The content of the game number counter 14 is displayed in a game number display 16, and is used to address a memory unit 20 that has stored therein a game pattern for each set. For the present invention memory capacity is provided to store patterns for a maximum of 30 games. The patterns that are stored in the 30 game pattern storage locations are selected from 66 game patterns permanently stored in read only memory. The output from the memory unit 20 is displayed in an LED matrix game pattern display 18 to indicate to the players the pattern on their respective bingo cards that must be completed in order to have a bingo. The contents of the memory unit 20 is preprogrammed via the timing and control unit 42 to store the game patterns that are desired for each set to be played. Timing and control unit 42 supplies the necessary clocking and control signals to the various blocks as shown in FIG. 1 to enable them to carry out their functions. It is within the level of skill of one with ordinary skill in the art to produce the clocking signals and the addressing circuits needed to synchronize the storing and readout of the contents of memory units 21 and 20 as well as the counting circuits of counters 14 and 26. Accordingly, a detailed description of those circuits are not presented herein. Additionally, random number generators are well known in the art for generating numbers in the range from 1 to 75, one of which could be selected for random number generator 34.

Figure 2:
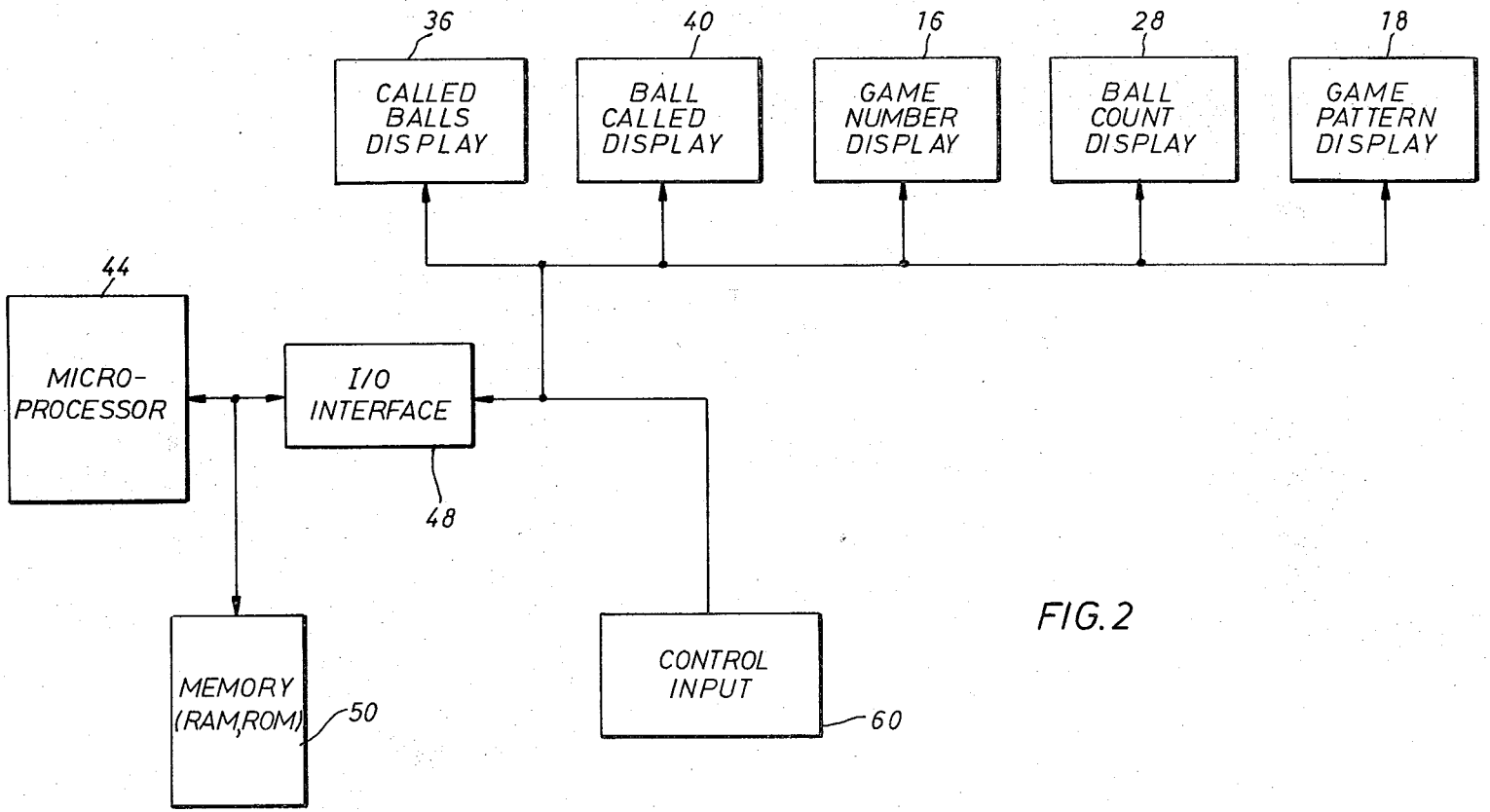
FIG. 2 is a block diagram of the preferred embodiment of the present invention.

Turning now to FIG. 2, a block diagram of the preferred embodiment of the present invention is illustrated. A programmed microprocessor 44 including a memory unit 50 and an I/O interface is provided for controlling the functions of the present invention. A control unit 60 is provided for inputting the information and clocking signals required by the microprocessor 44 to store the pre-selected game patterns and the other control signals which are hereinbelow discussed in more detail. The various display devices such as ball called display 36, ball call display 40, game number display 16, ball count display 28 and game pattern display 18 are connected to the I/O interface 48, and respond to the microprocessor 44 to obtain their respective displayed information.

Figure 3:
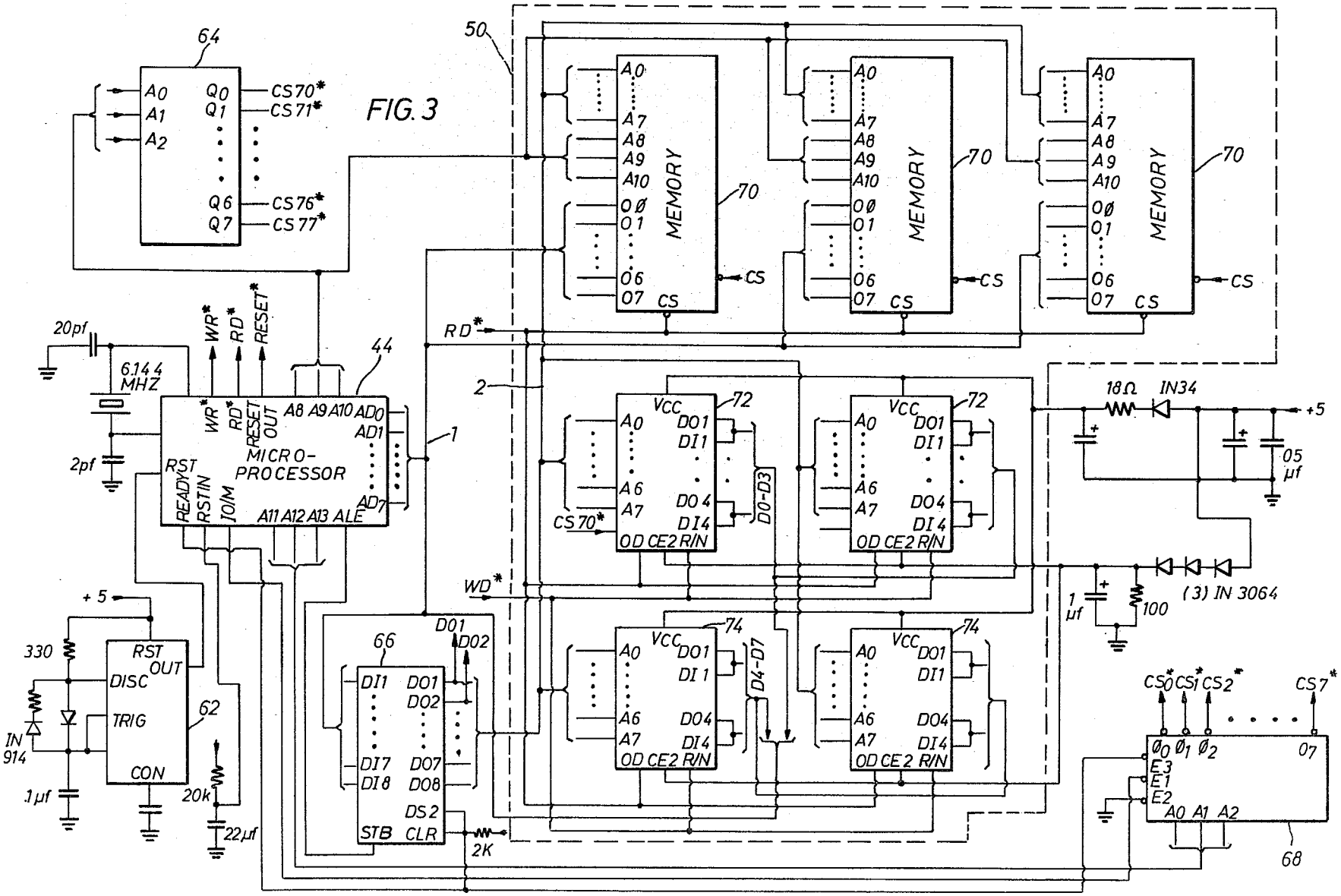
FIG. 3 is a more detailed circuit diagram of the microprocessor shown in FIG. 2.

Turning now to FIG. 3 in which a more detailed circuit diagram of the preferred embodiment of the present invention of FIG. 2 is shown, microprocessor 44 is connected to its main memory unit 50 via an address/data bus 1. Memory unit 50 consists of RAM memory units 70 and ROM memory units 72, 74. For the preferred embodiment of the present invention, microprocessor 44 is manufactured and sold by Intel Corporation as its model 8085A microprocessor. The address data on bus 1 is strobed into register 66 to produce on its output an 8-bit address that is applied to each of the memory units in memory unit 50. Additionally, address lines A8, A9, and A10 from microprocessor 44 are inputted directly to memory units 70 along with the 8-bit address line from register 66 to form an 11-bit binary address for the memory units.

There is no need to buffer the address data from lines A8, A9, and A10 through register 66 because, for the present invention, only the least significant 8 bit lines of bus 1 serve as both address and data lines. Register 66 functions to separate the address date on bus 1 from the data that also appears on the bus. Octal decoders 68 and 64 are provided to respectively decode address lines A11, A12 and A13 and A8, A9 and A10 from microprocessor 44 to produce chip select signals that are inputted to the various functional devices of the present invention, such as the memory units 70, 72 and 74, to enable the devices to perform their functions. The data read from main memory unit 50 is applied to the address/data bus 1 and used by microprocessor 44.

Turning now to FIGS. 4(A) and (B), the I/O interface 48 shown in FIG. 2 is illustrated in more detail. Interface units 76 are provided for interfacing the data from the control unit 60 into the microprocessor data bus 2, and for outputting the data from the microprocessor 44 to the various display units. The interface units 76 are manufactured and sold by Intel Corporation as their 8255 I/O interface chip. The operation of these interface circuits are well known to those skilled in the art, and a detailed description will not be provided herein.

Figure 5:
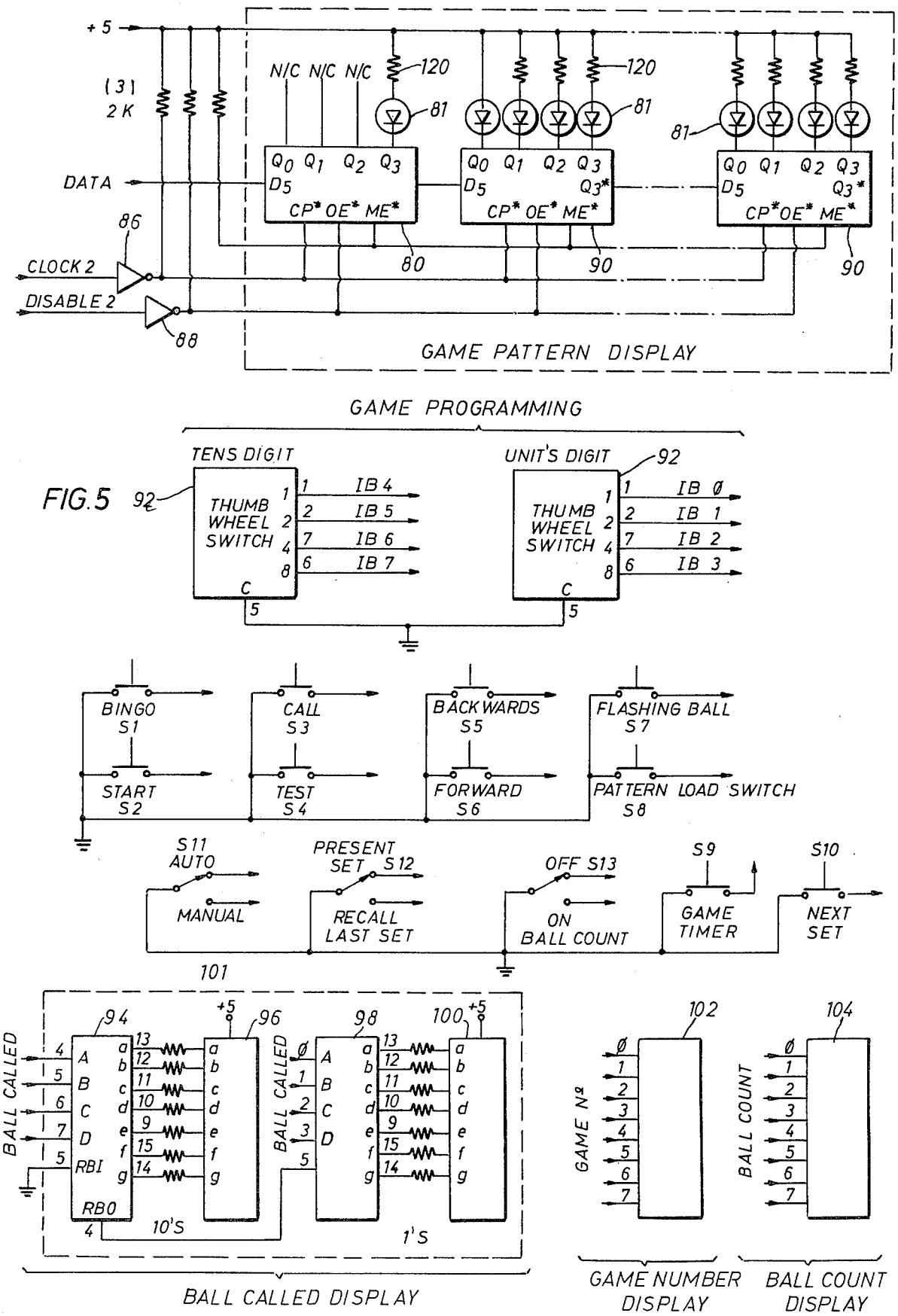
FIG. 5 is a circuit diagram of the control input unit illustrated in FIG. 2.

Also illustrated in FIG. 4(A) is a more detailed circuit diagram of the ball call display 52. The display 52 consists of a set of LED elements 81 connected in series with a 120 ohm resistor and one output of a 4-bit shift register 82. For the preferred embodiment of the present invention, LEDs 81 are manufactured and sold by Monsanto Corporation as their model MV 5753. Shift registers 82 (also shift registers 90 as shown in FIG. 5) are designated as SN74LS395 4-bit shift registers from Texas Instruments. Each shift register 82 is connected in series such that the information supplied by microprocessor 44 and presented at the DATA input is serially shifted through the various bit positions of shift registers 82 in response to the CLOCK 1 signal also outputted by the microprocessor 44. The CLOCK 1 signal is inverted by inverter 78 to provide the shift pulse for each of the shift register units 82. At the completion of 75 shift pulses, the contents of the shift registers 82 will contain the information corresponding to the balls that have thus far been called. If a ball has been called, a logic 0 (zero voltage level) will be stored in the corresponding register 82 bit location to light the LED for that particular ball. The microprocessor 44 is programmed to output the ball called information as each ball is called. In a similar manner, the information displayed in the game pattern display 18 shown in FIG. 5 is outputted by the microprocessor 44 and is stored in respective shift register elements 90. The LEDs of display 18 form a 5×5 matrix simulating the positions on a standard bingo card. Accordingly, 25 shift pulses are required.

Turning now to FIG. 5, the control switches for operating the present invention and for preprogramming data into microprocessor 44 are shown. Two digital thumb wheel switches 92 are used to produce two 4-bit BCD coded data words that will be interpreted by the microprocessor 44 according to which of the control switches are actuated. For example, to program a game pattern into the memory unit 50, a predetermined two-digit number is encoded into the thumb wheel switches 92 corresponding to the desired game pattern. The pattern load switch S8 is then actuated to cause microprocessor 44 to read the contents of the thumb wheel switches 92 and load that data into the memory location corresponding to the set number currently being displayed on the game number display 54. Similarly, the predetermined number for the ball count that will cause the ball count to be flashed on and off will be inputted by programming switches 92 and depressing flashing ball switch S7. Also, the time interval between called balls is inputted by programming switches 92 with a time interval between 1 and 99 seconds and actuating game timer switch S9.

Included with this detailed description of the preferred embodiment is an appendix containing the software program listing for the microprocessor 44. The following is a brief description of the various routines of that program. The program is written in PL/M block structured level programming language that is well-known in the art.

SWITCH Procedure

The function of this procedure is to monitor the condition of the control unit 60 switches and to store a logic 1 in a memory location assigned to each switch if the switch is closed, or a logic 0 if the switch is open.

FIVE$MSEC Procedure

The function of this procedure is to increment all five software timers and to output one row of the bingo letter display ever 5 milliseconds. The bingo letter displayed to the players is constructed from a 5×7 array of led lights.

PAT$OUT Procedure

The function of this procedure is to output a logic 1 or a logic 0, and to generate the clock pulse to output to the 25 bit pattern shift registers the data for the game pattern for the current set.

BIT$OUT Procedure

The function of this procedure is to output a logic 1 or a logic 0 and to generate a clock pulse to output the data for the 75 bit pattern shift register that will display the bingo numbers called.

PLEDS 1 Procedure

This procedure disables the 25 pattern LED's during the running of this procedure to prevent smearing of the pattern display 18. The patterns are stored in a structured table of 66 patterns each consisting of 5 bytes. Each byte has the lower 5 bits representing one row of the five LED's. Five rows are output sequentially to make up the full 25 bit pattern.

PLEDS Procedure

This procedure checks for game numbers greater than 66, which are the standard bingo multiple pattern games. If the number is less than 66 the pattern number is referenced directly. The multiple pattern game patterns are outputted by the MAIN LOOP program in sequence every five seconds. Three extra bits and clocks are generated to shift the data to the correct position in the 28 bit pattern shift registers (see FIG. 5).

NLEDS Procedure

This procedure disables the 75 bingo numbers LED's during the running of this procedure to prevent smearing of bingo display 36. The numbers are stored in a table of 75 bytes with the current set data in the least significant bit and the last set data in the most significant bit of each of the 75 bytes. The procedure determines the position of the current set/previous set switch and outputs the appropriate data by calling the BIT$OUT 75 times.

BCD Procedure

This procedure converts a binary number in byte location Y to a BCD number in the same location. If the binary number in Y is zero, the procedure returns since no conversion is necessary. If the number is greater than zero, the procedure divides the number by 10 and shifts to the result to the left four places to form the ten's digit of the BCD number. It then logically OR's the remainder from the division with the ten's digit to produce a BCD number in the range of 1 to 99.

NEXT SET Routine

This routine does a number of things to prepare the machine to start a new set. These are:

1. Select a new seed for the random # generator.
2. Reset start flag.
3. Move old set data from the LSB of each of the 75 number storage byte to the MSB of each of the 75 number storage bytes, and clear the LSB's at the same time.
4. Save the last ball count.
5. Save the last number called.
6. Save the last letter called.
7. Reset ball 75 flag.
8. Reset current bingo number, 'N'.
9. Display all 75 numbers in the cleared state.
10. Zero brings number window.
11. Zero ball count window.
12. Zero ball count byte 'BALL$COUNT'.
13. Blank bingo letter.
14. Display current bingo pattern on 25 LEDS of display 18.

RNGEN Procedure

The random number procedure starts with a seed number which is changed every time the "NEXT SET Routine" switch is depressed. The new seed number is generated by "or" ing the Time 1 counter with a numerical 1 to select only odd numbers.

The RNGEN procedure multiplies the SEED by 899 and stores the new value in LOC1 and the SEED location. It then divides the contents of LOC1 by 76 and stores this value in location LOC2.

The next step multiplies LOC2 by 76 and subtracts the result from LOC1. The result of the subtraction is the randon number (N) in the range from 1 to 75.

The program then adds 1 to the random number N, if it is less than 74, and checks to see if this number has already been called. If it has, the program loops back to the beginning until it finds a number from 1 to 75 which has not been called.

BINGO$NUMBER Procedure

This procedure selects a new bingo number and letter. It also increments the ball count, and tests for game patterns which do not have 'N's. If the pattern does not have 'N's, then another number is found which is not a N.

DELAY Procedure

This procedure provides a delay of approximately one second.

DELAY 1 Procedure

This procedure provides a delay of X seconds depending on the value selected on the thumbwheel switch.

TEST 1 Procedure

This procedure calls BINGO$NUMBER procedure and waits for a thumbwheel selected time interval by calling the DELAY 1 procedure.

ESCAPE Procedure

This procedure allows the operator to terminate a test sequence before it runs to completion. The ESCAPE sequence calls the NEXT$SET$ROUTINE and sets the game number to 1.

MAIN PROGRAM Sequence Begin

This sequence initializes the hardware and software when power is applied to the machine. The first part of the sequence is executed during all power up sequences and includes the following:

1. Set up interrupt mask to enable timer interrupt every 5 milliseconds.
2. Initialize interface chips 76.
3. Initialize control bytes and timers.
4. Initialize switch control bytes.
5. Initialize bingo number LED's.
6. Initialize pattern LED's.
7. Initialize bingo number display.
8. Initialize ball count.

The second part of the sequence is executed only on a cold start up where the contents of the RAM memory have been lost. The fact that the memory data is invalid is determined by reading byte Memory$Good which should be 55H if the memory is still valid.

MAIN$LOOP Procedure

The main program loop executes continuously once the initialization sequence is complete. This loop consists of the following steps:

1. Enable interrupts.
2. Let Memory$Good to 55H.
3. Every 5 seconds perform the following:
   A. Reset timer for next time.
   B. Increment sequence number from 0 to 5.
   C. Get the pattern number for the current game from the pattern table and store in the Game$Temp byte.
   D. If Game$Temp is 66, which is the code number for a regular bingo with 3 patterns, then display one of the three patterns for the next five seconds.
   E. If Game$Temp is 67, which is the code number for a regular bingo with 6 patterns, then display one of the six patterns for the next five seconds.
   F. Call PLEDS to display the pattern.
4. Read the bingo switch and stop the game as soon as it is pushed.
5. Every ½ second read all the switches by calling the SWITCH routine. Reset the timer. Reset all monetary push-buttons after they have been read.

6. If the ball count on/off switch is in the ON position enable the ball count display. If it is OFF disable the ball count display.

7. If the Backwards byte is set decrement the game number and display the new number and game pattern.

8. If the Forwards byte is set increment the game number and display the new number and game pattern.

9. If the Next$Set byte is set call the NEXT$SET$-ROUTINE to start a new set.

10. If the start byte is set, set the Start$Flag and load Timer 1 with the Time limit value so that the program will call the next ball immediately.

11. If the Present$Set byte is set do the following:

A. Set$Present$Set$Flag

B. Check for Present$Set$Flag and Last$Set$Flag both equal to 1. If true, restore present ball count, bingo number, and bingo letter and output bingo numbers to the 75 Leds of display 36 one time.

C. Reset Last$Set$Flag. This prevents step B from executing more than one time.

12. If the Last$Set byte is set do the following:

A. Set Last$Set$Flag.

B. Check for Present$Set$Flag and Last$Set$Flag both equal to 1. If true, output the last ball count from the last set, the last game numbers, and the last bingo letter. Save the current contents of the Letter$PTR in the Last$Letter$PTR in the Letter$PTR byte to display the last letter from the last set. Output the bingo numbers to the 75 Leds one time.

C. Reset the Present$Set$Flag. This prevents step B from executing more than one time.

13. If the Present$Set byte is set then do the following:

A. If the Auto/Manual switch is in Auto and Timer 1 has reached the time limit entered on the thumbwheel switch, then reset Timer 1 and if the Start$-Flag is set and Ball 75 is reset, (all 75 ball have not been called) then call RNGEN to get a random number and BINGO$NUMBER to display the number, to display the letter, and to light one of the 75 bingo LEDS.

B. If the Auto/Manual switch is in Manual and the Call switch has been pressed, then check to see if Ball 75 is reset. If Ball 75 is reset then call RNGEN to get a random number and BINGO$NUMBER to display the number, to display the letter, and to light one of the 75 bingo Leds. Then delay to prevent calling two numbers if the Call switch is held down too long.

14. If the Game$Timer byte is set the program reads the thumbwheel switch value which has been converted to binary by the SWITCH procedure. The program checks for zero and places a value of 100 to give a ½ second time if zero is dialed up. Otherwise, the correct value for the number of seconds on the thumbwheel switch is entered into Time$Limit.

15. If the Pattern$SW byte is set, the binary equivalent of the thumbwheel switch value is stored in the Pattern$Table entry for the current game number. The new pattern is then displayed by calling PLEDS.

16. If the Flashing$Ball byte is set, the panel ballcount and the public ballcount are disabled for the Delay 1 time and the enabled so as to flash the ballcount displays.

17. If the Test byte is set and the thumbwheel switch is set to 99 a test sequence is initiated. The 99 setting is used to prevent accidental initiation of the Test. The TEST sequence is listed below.

A. Stop the game and reset by calling the NEXT$SET$ROUTINE.

B. Display the letters B-I-N-G-O on the pattern display at approximately 3 second intervals. Check for depression of the Bingo switch to escape from this sequence.

C. Display each of the 30 game patterns along with its associated game number for five seconds. When the game is a standard bingo a blank game pattern is display for five seconds. If the bingo switch is pushed the test program will cease and the machine will be ready for a new set.

18. Go back to MAIN$LOOP Step 1 and continue forever.

In describing the invention, reference has been made to a preferred embodiment. However, those skilled in the art and familiar with the disclosure of the invention may recognize additions, deletions, substitutions or other modifications which would fall within the purview of the invention as defined in the appended claims.

PL/M-80 COMPILER DEC 27 79 PAGE 1

APPENDIX A

```
ISIS-II PL/M-80 V3.1 COMPILATION OF MODULE SATURN
OBJECT MODULE PLACED IN :F1:SATURN OBJ
COMPILER INVOKED BY:  PLM80 :F1:SATURN SRC

          $DATE (DEC 27 79)
          $INTVECTOR (4,0)
 1        SATURN:
          DO;
 2  1     DECLARE DCL LITERALLY 'DECLARE';
 3  1     DCL Z1$PORT$A BYTE AT (1000H);
 4  1     DCL Z1$PORT$B BYTE AT (1001H);
 5  1     DCL Z1$PORT$C BYTE AT (1002H);
 6  1     DCL Z2$PORT$A BYTE AT (1800H);
 7  1     DCL Z2$PORT$B BYTE AT (1801H);
 8  1     DCL Z2$PORT$C BYTE AT (1802H);
 9  1     DCL Z3$PORT$A BYTE AT (2000H);
```

```
10  1     DCL Z3$PORT$B BYTE AT (2001H);
11  1     DCL Z3$PORT$C BYTE AT (2003H);
12  1     DCL Z1$CONTROL BYTE AT (1003H);
13  1     DCL Z2$CONTROL BYTE AT (1803H);
14  1     DCL Z3$CONTROL BYTE AT (2003H);

15  1     DCL MAIN$LOOP LABEL;
16  1     DCL VECTOR (3) BYTE AT (38H) DATA(2CH,0,0);
17  1     DCL PRESENT$SET$FLAG BYTE;
18  1     DCL LAST$SET$FLAG BYTE;
19  1     DCL BCD$TW BYTE;
20  1     DCL BACKWARDS BYTE;
21  1     DCL FLASHING$BALL BYTE;
22  1     DCL FORWARD BYTE;
23  1     DCL PATTERN$SW BYTE;
24  1     DCL CALL$SW BYTE;
25  1     DCL START BYTE;
26  1     DCL TEST BYTE;
27  1     DCL GAME$TIMER BYTE;
28  1     DCL NEXT$SET BYTE;
29  1     DCL AUTO BYTE;
30  1     DCL LAST$SET BYTE;
31  1     DCL PRESENT$SET BYTE;
32  1     DCL (G1,G2) BYTE;
33  1     DCL TIME$LIMIT ADDRESS;
34  1     DCL PATTERN$TABLE (31) BYTE;
35  1     DCL START$FLAG BYTE;
36  1     DCL BINARY$TW BYTE;
37  1     DCL FB$FLAG BYTE;
38  1     DCL GAME$TEMP BYTE;
39  1     DCL TEMP BYTE;
40  1     DCL GAMENUMBER BYTE;
41  1     DCL SEED ADDRESS;
42  1     DCL (LOC1, LOC2) ADDRESS;
43  1     DCL BALL$COUNT BYTE;
44  1     DCL (A,C,D,P,N,W,I,B,V,X,Y)BYTE;
45  1     DCL SUM BYTE;
46  1     DCL INDEX BYTE;
47  1     DCL AC BYTE;
48  1     DCL SEQUENCE BYTE;
49  1     DCL GAME$POINTER BYTE;
50  1     DCL LETTER$B (5) BYTE
               DATA(1111111B,1001001B,1001001B,1001001B,0110110B);
51  1     DCL LETTER$I (5) BYTE
               DATA(0,1000001B, 1111111B,1000001B,0);
52  1     DCL LETTER$N (5) BYTE
               DATA(1111111B,0000010B,0001000B,0100000B,1111111B);
53  1     DCL LETTER$G (5) BYTE
               DATA(0111110B, 1000001B, 1010001B,1010001B,0110010B);
54  1     DCL LETTER$O (5) BYTE
               DATA(0111110B,1000001B,1000001B,1000001B,0111110B);
55  1     DCL LETTER$BLANK (5) BYTE
               DATA(0,0,0,0,0);
56  1     DCL LETTER$PTR ADDRESS;
57  1     DCL TOGGLE BYTE;
58  1     DCL MEMORY$GOOD BYTE;
59  1     DCL (TIMER1,TIMER3,TIMER4,TIMER5) ADDRESS;
60  1     DCL ALPHA BASED LETTER$PTR (5) BYTE;
61  1     DCL TIMER2 BYTE;
62  1     DCL LAST$BALL$COUNT BYTE;
63  1     DCL LAST$N BYTE;
64  1     DCL LAST$LETTER$PTR ADDRESS;
65  1     DCL BALL75 BYTE;
66  1     DCL CURRENT$LETTER$PTR ADDRESS;
67  1     DCL NUMBER(76) BYTE;
68  1         DCL PATTERN (66) STRUCTURE (NIBBLE (5) BYTE)
                   DATA(04H,00H,11H,00H,04H,
                        11H,00H,00H,00H,11H,
                        00H,04H,0AH,04H,00H,
                        10H,08H,04H,02H,01H,
                        01H,02H,04H,08H,10H,
                        00H,00H,1FH,00H,00H,
                        04H,04H,04H,04H,04H,
```

```
                    1FH,1FH,1FH,1FH,1FH,
                    1FH,09H,0EH,09H,1FH,
                    1FH,04H,04H,04H,1FH,
                    1FH,11H,17H,10H,1FH,
                    1FH,11H,11H,11H,1FH,
                    00H,00H,00H,00H,00H,
                    07H,04H,04H,04H,1CH,
                    1CH,04H,04H,04H,07H,
                    04H,04H,1CH,02H,01H,
                    11H,11H,1FH,04H,04H,
                    04H,04H,1FH,11H,11H,
                    1FH,08H,04H,02H,1FH,
                    1FH,02H,04H,08H,1FH,
                    04H,04H,04H,0AH,1FH,
                    0EH,04H,04H,0AH,1FH,
                    04H,0AH,11H,0AH,04H,
                    11H,04H,0AH,04H,11H,
                    07H,02H,04H,08H,1CH,
                    04H,04H,04H,0AH,11H,
                    1FH,0AH,04H,04H,04H,
                    11H,0AH,04H,04H,04H,
                    11H,11H,11H,0AH,04H,
                    1FH,11H,11H,0AH,04H,
                    00H,00H,1FH,0EH,04H,
                    1FH,0EH,04H,00H,00H,
                    04H,08H,1FH,08H,04H,
                    10H,08H,04H,02H,1FH,
                    1FH,02H,04H,08H,10H,
                    01H,02H,04H,08H,1FH,
                    01H,01H,01H,01H,1FH,
                    10H,10H,10H,10H,1FH,
                    10H,08H,05H,03H,07H,
                    1FH,08H,04H,02H,01H,
                    1CH,18H,15H,03H,07H,
                    1CH,18H,14H,02H,01H,
                    01H,02H,14H,18H,1CH,
                    04H,0AH,1FH,00H,00H,
                    00H,00H,1FH,0AH,04H,
                    10H,10H,1CH,10H,1FH,
                    04H,04H,04H,15H,1FH,
                    04H,04H,1FH,00H,00H,
                    00H,00H,1FH,04H,04H,
                    00H,04H,1FH,04H,00H,
                    04H,04H,1FH,04H,04H,
                    01H,01H,15H,1CH,14H,
                    0EH,04H,04H,04H,0EH,
                    04H,04H,07H,08H,10H,
                    00H,10H,1FH,01H,00H,
                    00H,00H,1FH,11H,11H,
                    01H,01H,1FH,10H,10H,
                    11H,11H,1FH,00H,00H,
                    11H,13H,15H,19H,11H,
                    10H,18H,15H,03H,01H,
                    01H,03H,15H,18H,10H,
                    11H,0AH,04H,0AH,11H,
                    00H,11H,1FH,11H,00H,
                    11H,0AH,04H,08H,10H,
                    1BH,1BH,00H,1BH,1BH,
                    00H,00H,00H,00H,00H);
69  1     S$MASK:  PROCEDURE(X) EXTERNAL;
70  2         DCL X BYTE;
71  2     END S$MASK;

72  1     SWITCH:  PROCEDURE; /*INPUT ALL SWITCHES*/
73  2         BCD$TW = NOT(Z1$PORT$A); /*BCD VALUE OF THUMBWHEEL
               SWITCHES */
74  2         BINARY$TW = ((10*(SHR(BCD$TW AND OFOH,4))) +
               (BCD$TW AND OFH));

75  2         G1 = NOT(Z1$PORT$B);
76  2         PATTERN$SW = (G1 AND 1);
77  2         FLASHING$BALL = (G1 AND 2);
78  2         TEST = (G1 AND 4);
```

```
 79  2          CALL$SW = (G1 AND 8);
 80  2          AUTO = (G1 AND 32);
 81  2          START = (G1 AND 128);

 82  2          G2 = NOT(Z1$PORT$C);
 83  2          BACKWARDS = (G2 AND 4);
 84  2          FORWARD = (G2 AND 8);
 85  2          PRESENT$SET = (G2 AND 16);
 86  2          LAST$SET = (G2 AND 32);

 87  2         NEXT$SET = (G2 AND 64);
 88  2         GAME$TIMER = (G2 AND 128);

 89  2     END SWITCH;


 90  1     FIVE$MSEC:  PROCEDURE INTERRUPT 15;
 91  2         DO;
 92  3         TIMER5 = TIMER5 + 1; /*BUMP TIMER 5*/
 93  3         TIMER4 = TIMER4 + 1; /*BUMP TIMER 4*/
 94  3         TIMER3 = TIMER3 + 1; /*BUMP TIMER 3*/
 95  3         TIMER2 = TIMER2 + 1; /*BUMP TIMER 2*/
 96  3         TIMER1 = TIMER1 + 1; /*BUMP TIMER 1*/
 97  3         IF AC < 4  /*UPDATE ALPHA DISPLAY*/
                   THEN AC = AC + 1;
 99  3             ELSE AC = 0;

100  3         Z3$PORT$B = OFFH; /*DISABLE COLUMN*/
101  3         Z3$PORT$A = ALPHA(AC); /*ROW DATA TO DISPLAY*/
102  3         Z3$PORT$B = ROL(01111111B, (AC+1); /*ENABLE COLUMN*/
103  3         END;

104  2     END FIVE$MSEC;

105  1     PAT$OUT:  PROCEDURE;
106  2         IF W = 1
                   THEN Z3$PORT$C = 0AH;
108  2             ELSE Z3$PORT$C = 0BH;
109  2         Z3$PORT$C = 07H;
110  2         Z3$PORT$C = 06H;
111  2     END PAT$OUT;

112  1     BIT$OUT:  PROCEDURE;
113  2         IF W = 1
                   THEN Z3$PORT$C = 0AH;
115  2             ELSE Z3$PORT$C = 0BH;
116  2         Z3$PORT$C = 0DH;
117  2         Z3$PORT$C = 0CH;
118  2     END BIT$OUT;


119  1     PLEDS1:  PROCEDURE;

                        /*OUTPUT PATTERN*/
120  2     Z3$PORT$C = 04H; /*PATTERN DISABLE*/

121  2         DO P = 0 TO 4;
122  3             DO I = 1 TO 5;
123  4                 W = (PATTERN(GAME$POINTER).NIBBLE(P) AND
                           ROL (80H, I));
124  4                 W = ROR(W, I+7);
125  4                 CALL PAT$OUT;
126  4         END;
127  3     END;

128  2     W = 0;
129  2     CALL PAT$OUT;
130  2     CALL PAT$OUT;
131  2         CALL PAT$OUT; /*OUTPUT 3 EXTRA BITS*/

132  2     Z3$PORT$C =05H; /*LEDS DISABLE*/
133  2     END PLEDS1;

134  1     PLEDS:  PROCEDURE;
```

```
135  2        IF PATTERN$TABLE(GAMENUMBER) < 66
                 THEN GAME$POINTER = PATTERN$TABLE(GAMENUMBER);
137  2        CALL PLEDS1;
138  2    END PLEDS;

139  1    NLEDS:  PROCEDURE; /*OUTPUT NUMBER LEDS*/
140  2        Z3$PORT$C = 0EH; /*LEDS DISABLE*/

141  2        I= 76; /*75 TO 1 = 75 LOOPS*/
142  2        DO WHILE I >= 1;
143  3            I = I - 1; /*FIRST =75, LAST = 1 */
144  3            IF PRESENT$SET = 16 /*OUTPUT PRESENT SET*/
                      THEN DO;
146  4                     W = (NUMBER(I) AND 1);
147  4                     CALL BIT$OUT;
148  4                 END;
149  3            IF LAST$SET = 32
                      THEN DO;
151  4                     W = (NUMBER(I) AND 80H);/*OUTPUT LAST SET*/
152  4                     W = ROL(W,1);
153  4                     CALL BIT$OUT;
154  4                 END;
155  3    END;

156  2        Z3$PORT$C = 0FH; /*LEDS ENABLED*/

157  2    END NLEDS;


158  1    BCD:  PROCEDURE; /*CONVERTS # IN Y TO BCD # IN Y*/

159  2        IF Y = 0
                 THEN RETURN;
161  2        Y = ((SHL((Y/10),4)) OR (Y NOD 10));
162  2    END BCD;
163  1    NEXT$SET$ROUTINE:  PROCEDURE;

164  2        SEED = (TIMER3 OR 1); /*CHOOSE NEW ODD # SEED*/
165  2        START$FLAG = 0;
166  2        DO B = 0 TO 75;
167  3            NUMBER(B) = SHL(NUMBER(B), 1); /*ERASE LAST SET*/
168  3            NUMBER(B) = ROR(NUMBER(B), 2); /*P SET TO L SET*/
169  3        END;
170  2        LAST$BALL$COUNT = BALL$COUNT; /*SAVE LAST BALL COUNT*/
171  2        LAST$N = N; /*SAVE LAST NUMBER CALLED*/
172  2        LAST$LETTER$PTR = LETTER$PTR; /*SAVE LAST LETTER*/
173  2        BALL75 = 0; /*RESET BALL 75 FLAG*/
174  2        N = 0; /*ZERO BINGO NUMBER*/
175  2        CALL NLEDS; /*DISPLAY CLEARED LEDS*/
176  2        Z2$PORT$B =0; /*ZERO BINGO WINDOW*/
177  2        Z2$PORT$A = 0; /* BALL COUNT DISPLAY*/
178  2        BALL$COUNT = 0; /* BALL COUNT IN RAM*/
179  2        LETTER$PTR = LETTER$BLANK; /*BLANK APLHA CHAR*/
180  2        CALL PLEDS;

181  2    END NEXT$SET$ROUTINE;


182  1    RNGEN:  PROCEDURE;
183  2    LOOP:  LOC1 = SEED*899;
184  2        SEED = LOC1;
185  2        LOC2 = LOC1/76;
186  2        N = LOC1 - LOC2*76;
187  2        IF (TIMER2 AND 1) = 0;
             THEN DO;
189  3            IF N <74
                      THEN N = N+1;
191  3            END;
192  3        IF (NUMBER(N) AND 1) = 1 /*NUMBER ALREADY CALLED*/
                 THEN DO;  /*HAVE ALL #'S BEEN CALLED*/
194  3                SUM = 0;
195  3                LP1:  DO C = 1 TO 75;
```

```
196  4                    SUM = (SUM +(NUMBER(C) AND 1));
197  4                     END;
198  3                IF SUM = 75
                       THEN DO;
200  4                      CALL NEXT$SET$ROUTINE;
201  4                      BALL75 = 1;
202  4                      RETURN;
203  4                    END;
204  3                GO TO LOOP;
205  3        END;

206  2    END RNGEN;

207  1    BINGO$NUMBER:  PROCEDURE;

208  2        IF BALL$COUNT > 75
             THEN DO;
210  3            CALL NEXT$SETROUTE;
211  3            GO TO X5; /*RETURN*/
212  3        END;
213  2        TEMP = NUMBER(N) AND 80H; /*PERSERVE LAST SET*/
214  2        NUMBER(N) = (TEMP OR 1);  /*SET BINGO LED BIT*/
215  2        CALL NLEDS;


             /*BINGO LETTER TO WINDOW*/

216  2                   IF N < 16
                          THEN DO;
218  3                        LETTER$PTR = LETTER$B;
219  3                        GO TO X3;
220  3                     END;
221  2                   IF N < 31
                          THEN DO;
223  3                        LETTER$PTR = LETTER$I;
224  3                        GO TO X3;
225  3                     END;

226  2                   IF N < 46
                          THEN DO;
228  3                        IF PATTERN$TABLE(GAMENUMBER) > 65
                               THEN GO TO X2;/*SKIP NEXT TEST*/
230  3                        IF PATTERN$TABLE(GAMENUMBER) > 53
                               THEN DO; /*CALL ANOTHER BALL IN 1 SEC*/
232  4                            TIMER1 = TIME$LIMIT - 200;
233  4                                   GO TO X5;/*NO N'S ON WINDOW*/
234  4                             END;
235  3    X2:                 LETTER$PTR = LETTER$N;
236  3                            GO TO X3;
237  3                      END;

238  2                    IF N < 61
                           THEN DO;
240  3                         LETTER$PTR = LETTER$G;
241  3                         GO TO X3;
242  3                      END;
243  2                    LETTER$PTR = LETTER$0;
244  2        IF N = 0
                 THEN GO TO X4; /*DON'T DISPLAY BALL 00 */

246  2    X3:     Y = N;
247  2        CALL BCD; /*BINGO NUMBER TO WINDOW*/
248  2        Z2$PORT$B = Y;

249  2        BALL$COUNT = BALL$COUNT + 1;
250  2    X4: Y = BALL$COUNT;
251  2        CALL BCD;
252  2        Z2$PORT$A = Y; /*OUTPUT BALL COUNT*/

253  2    X5: END BINGO$NUMBER;


254  1    DELAY:  PROCEDURE;
255  2        DO C = 0 TO 125;
```

```
256  3            CALL TIME(250);
257  3        END;
258  2    END DELAY;


259  1    DELAY1:  PROCEDURE;
260  2        DO C = 0 TO (TIME$LIMIT/10);
261  3            CALL TIME(250);
262  3        END;
263  2    END DELAY1;

264  1    TEST1:  PROCEDURE;
265  2        CALL BINGO$NUMBER;
266  2        CALL DELAY1;
267  2    END TEST1;

268  1    ESCAPE:  PROCEDURE;
269  2        IF ( NOT(Z1$PORT$B) AND 64) = 64 /*BINGO SW
               TERMINATES TEST*/
                THEN DO;
271  3                CALL NEXT$SET$ROUTINE;
272  3                GAMENUMBER = 1;
273  3                CALL PLEDS;
274  3                GO TO MAIN$LOOP;
275  3            END;
276  2    END ESCAPE;
                /*:::::::::::START OF MAIN PROGRAM::::::::::::*/

277  1    BEGIN:  DISABLE:
278  1        CALL S$MASK(0BH); /*SET UP INTERRUPT MASK*/
279  1        Z1$CONTROL = 9BH; /*INITIALIZE HARDWARE*/
280  1        Z2$CONTROL,Z3$CONTROL = 80H;
281  1        TOGGLE = 1;

282  1        TIMER1,TIMER2,TIMER3,TIMER4, START$FLAG = 0;
283  1        CALL SWITCH;/*INITIALIZE SWITCH CONTROL BYTES*/
284  1        CALL NLEDS;
285  1        CALL PLEDS;
286  1        Y = N;
287  1        CALL BCD;
288  1        Z2$PORT$B = Y; /*BINGO NUMBER TO WINDOW*/
289  1        Y = BALL$COUNT;
290  1        CALL BCD;
291  1        Z2$PORT$A = Y; /*OUTPUT BALL COUNT*/

292  1        IF MEMORY$GOOD = 55H
                THEN GO TO MAIN$LOOP;
294  1        GAMENUMBER = 1;

295  1        DO C = 0 TO 7;
296  2            CALL NEXT$SET$ROUTINE; /*8X TO CLEAR PSET AND LSET*/
297  2        END;

298  1        DO C = 0 TO 30;
299  2            PATTERN$TABLE(C) = 7;
300  2        END;
301  1        TIME$LIMIT = 1000;

302  1    MAIN$LOOP:
             ENABLE; /*INTERRUPTS ON*/
303  1        MEMORY$GOOD = 55H;
304  1        IF TIMER4 > 1000 /*5 SECONDS*/
                THEN DO;
306  2            TIMER4 = 0;
307  2                IF SEQUENCE = 5 /*SEQ REG BINGO'S*/
                       THEN SEQUENCE = 0;
309  2                  ELSE SEQUENCE = SEQUENCE + 1;
310  2                  GAME$TEMP = PATTERN$TABLE(GAMENUMBER);
311  2              IF GAME$TEMP = 66
                      THEN DO;
313  3                  DO CASE SEQUENCE;
314  4                    GAME$POINTER = 6;
315  4                    GAME$POINTER = 5;
```

```
316  4                        GAME$POINTER = 3;
317  4                        GAME$POINTER = 6;
318  4                        GAME$POINTER = 5;
319  4                        GAME$POINTER = 3;
320  4                      END;
321  3                      CALL PLEDS;
322  3                    END;

323  2                  IF GAME$TEMP = 67
                          THEN DO;
325  3                      DO CASE SEQUENCE;
326  4                        GAME$POINTER = 6;
327  4                        GAME$POINTER = 5;
328  4                        GAME$POINTER = 3;
329  4                        GAME$POINTER = 2;
330  4                        GAME$POINTER = 0;
331  4                        GAME$POINTER = 1;
332  4                      END;

333  3               CALL PLEDS;
334  3                    END;
335  2        END;

336  1        IF(NOT(Z1$PORT$B) AND 64) = 64 /*READ BINGO SWITCH
                                                  RAPIDLY*/
                THEN START$FLAG = 0; /*STOP GAME WHEN BINGO IS
                                                  PUSHED*/


338  1    IF TIMER2 > 100 /*READ SWITCHES EVERY 1/2 SEC*/
                  THEN DO;
340  2            TIMER2 = 0;
341  2        CALL SWITCH;
342  2        TOGGLE = NOT(TOGGLE);


343  2           END; /*END OF 3/4 SEC THEN LOOP*/


             /*ELSE MOMENTARY PUSH BUTTONS RESET EVERY 3/4 SEC*/

344  1        ELSE BACKWARDS, FLASHING$BALL, FORWARD,
                  PATTERN$SW,  CALL$SW, START,
                  TEST, GAME$TIMER, NEXT$SET = 0;


345  1    IF(NOT(Z1$PORT$C) AND 1) = 1 /*PUBLIC BALL COUNT OFF*/
              THEN Z3$PORT$C = 2;
347  1         ELSE Z3$PORT$C = 3;

348  1    IF BACKWARDS = 4
              THEN DO;
350  2            IF GAMENUMBER = 1
                  THEN GO TO B1;
352  2            ELSE GAMENUMBER = GAMENUMBER - 1;
353  2            CALL PLEDS;
354  2        END;
355  1    B1:  IF FORWARD = 8
              THEN DO;
357  2            IF GAMENUMBER > 29
                      THEN DO;
359  3                    GAMENUMBER = 1;
360  3                    CALL PLEDS;
361  3                  END;
362  2                  ELSE DO;
363  3                    GAMENUMBER = GAMENUMBER + 1;
364  3                    CALL PLEDS;
365  3                  END;
366  2        END;
367  1    Y = GAMENUMBER;   /*CONTINUOUSLY OUTPUTS GAMENUMBER*/
368  1    CALL BCD; /*OUTPUT GAME NUMBER*/
369  1    Z2$PORT$C = Y;
```

```
370  1    IF NEXT$SET = 64
              THEN CALL NEXT$SET$ROUTINE; /*START NEW SET*/


372  1    IF START = 128
              THEN DO;
374  2           START$FLAG = 1;
375  2           TIMER1 = TIMELIMIT; /*CALL FIRST BALL IMMEDIATELY*/
376  2        END;
377  1    IF PRESENT$SET = 16
              THEN DO;
379  2           PRESENT$SET$FLAG = 1;
380  2           IF (PRESENT$SET$FLAG AND LAST$SET$FLAG) = 1
                    THEN DO;
382  3              Y = BALL$COUNT;
383  3              CALL BCD;
384  3              Z2$PORT$A = Y /*RESTORE BALLCOUNT*/
385  3              Y = N;
386  3              CALL BCD;
387  3              Z2$PORT$B = Y; /*RESTORE NUMBER*/
388  3              LETTER$PTR = CURRENT$LETTER$PTR;
389  3               CALL NLEDS; /*OUTPUT ONCE*/
390  3             END;

391  2           LAST$SET$FLAG = 0;
392  2        END;

393  1    IF LAST$SET = 32
              THEN DO;
395  2           LAST$SET$FLAG = 1;
396  2           IF (PRESENT$SET$FLAG AND LAST$SET$FLAG) = 1
                     THEN DO;
398  3               Y = LAST$BALL$COUNT;
399  3               CALL BCD;
400  3               Z2$PORT$A = Y; /*OUTPUT LAST BALL COUNT*/
401  3               Y = LAST$N;
402  3               CALL BCD;
403  3               Z2$PORT$B = Y; /*OUTPUT LAST NUMBER*/
404  3               CURRENT$LETTER$PTR = LETTER$PTR;
405  3               LETTER$PTR = LAST$LETTER$PTR;
406  3                CALL NLEDS; /*OUTPUT ONCE*/
407  3              END;

408  2           PRESENT$SET$FLAG = 0;
409  2        END;


410  1    IF PRESENT$SET = 16 /*CALL BALLS ONLY IN PRESENT SET*/
              THEN DO;
412  2    IF AUTO = 32
              THEN DO;
414  3           IF TIMER1 > TIME$LIMIT
                     THEN DO;
416  4                TIMER1 = 0;
417  4                 IF START$FLAG = 1
                           THEN DO;
419  5                          IF BALL75 = 0
                                THEN DO;
421  6                            CALL RNGEN;
422  6                            CALL BINGO$NUMBER;
423  6                          END;
424  5                      END;
425  4                                                END;
426  3           END;

427  2        ELSE DO; /*IF NOT IN AUTO, MUST BE IN MANUAL MODE*/
428  3           IF CALL$SW = 8
                     THEN DO;
430  4                IF BALL75 = 0
                      THEN DO;
432  5                     CALL RNGEN;
433  5                     CALL BINGO$NUMBER;
434  5                     CALL DELAY;
```

```
435  5                END;
436  4              END;
437  3        END;

438  2    END; /*END OF PRESENT SET ONLY CODE*/


439  1    IF GAME$TIMER = 128
             THEN DO;
441  2           IF BINARY$TW = 0
                     THEN TIME$LIMIT = 100;

443  2               ELSE TIME$LIMIT = 200*BINARY$TW; /* 1 SEC
                        TIMES TW SW VALUE*/
444  2        END;
445  1        IF PATTERN$SW = 1
                 THEN DO;
447  2               PATTERN$TABLE(GAME$NUMBER) = BINARY$TW;
448  2                       CALL PLEDS; /*DISPLAY NEW PATTERN*/
449  2           END;

450  1        IF FLASHING$BALL = 2/*FLASH BALLCOUNT */
                 THEN DO;
452  2               Z2$PORT$A = 0;/*BALLCOUNT OFF*/
453  2               Z3$PORT$C = 2; /*PUBLIC BALL COUNT OFF*/
454  2               CALL DELAY1;
455  2               Y = BALL$COUNT;
456  2               CALL BCD;
457  2               Z2$PORT$A = Y; /*RESTORE BALL COUNT*/
458  2               Z3$PORT$C = 3  /*PUBLIC BALLCOUNT ON*/
459  2               CALL DELAY1;
460  2           END;

461  1    IF TEST = 4
             THEN DO; /*INCREMENT TEST*/
463  2         IF BINARY$TW = 99 /*TEST ONLY WORKS IF TW = 99*/
                 THEN DO;
465  3           CALL NEXT$SET$ROUTINE; /*STOP GAME, RESET ALL*/
466  3           GAME$POINTER = 8; /*B*/
467  3           CALL PLEDS1;
468  3           DO N = 1 TO 15;
469  4               CALL ESCAPE;
470  4               CALL TEST1;
471  4           END;

472  3           GAME$POINTER = 9; /*I*/
473  3           CALL PLEDS1;
474  3           DO N = 16 TO 30;
475  4               CALL ESCAPE;
476  4               CALL TEST1;
477  4           END;

478  3           GAME$POINTER = 58; /*N*/
479  3           CALL PLEDS1;
480  3           DO N = 31 TO 45;
481  4               CALL ESCAPE;
482  4               CALL TEST1;
483  4           END;

484  3           GAME$POINTER = 10;/*G*/
485  3           CALL PLEDS1;
486  3           DO N = 46 TO 60;
487  4               CALL ESCAPE;
488  4               CALL TEST1;
489  4           END;

490  3           GAME$POINTER = 11; /*O*/
491  3           CALL PLEDS1;
492  3           DO N = 61 TO 75;
493  4               CALL ESCAPE;
494  4               CALL TEST1;
495  4           END;
496  3        CALL DELAY;
```

```
497  3        DO X = 1 TO 30;
498  4            GAMENUMBER = X;
499  4            Y = GAMENUMBER;
500  4            CALL BCD;
501  4            Z2$PORT$C = Y;
502  4            GAME$TEMP = (PATTERN$TABLE(GAMENUMBER));
                    /*DISPLAY 1ST STD PATTERN*/
503  4            IF GAME$TEMP = 66
                      THEN GAME$POINTER = 12;
505  4            IF GAME$TEMP = 67
                      THEN GAME$POINTER = 12;
508  4            DO C = 0 TO 250; /*5SEC DELAY*/
509  5                CALL ESCAPE;
510  5                CALL TIME(250);
511  5            END;
512  4              END;
513  3        GAMENUMBER = 1;
514  3        END; /*END OF TW = 99 BLOCK*/
515  2        END; /*END OF TEST BLOCK*/
516  1            GO TO MAIN$LOOP;

517  1    END SATURN;


MODULE INFORMATION:

     CODE AREA SIZE      = 0ABCH   2748D
     VARIABLE AREA SIZE  = 00AFH    175D
     MAXIMUM STACK SIZE  = 000EH     14D
     704 LINES READ
     0 PROGRAM ERROR(S)

END OF PL/M-80COMPILATION
```

What is claimed is:

1. An electronic bingo game played as a series of sets with each set consisting of one or more bingo games played as a series of called bingo numbers, each set initiated under command of a bingo caller, and where a bingo winner is determined by completing a predetermined bingo card pattern, the game comprising:

(a) a variable timer, for automatically timing the interval between bingo number selections in a set to give the game players a constant rate of bingo numbers called, the timer interval selectively variable over a predetermined range, said timer including means for manual setting of the timer inverval;

(b) a pattern storing means, for storing for a predetermined number of sets, the bingo pattern for each game in each set, said pattern storing means outputting for display at the start of each game the pattern for the next game to be played;

(c) a game counter responsive to initiation of a next game, for counting and displaying the number of games played;

(d) a number counter responsive to said timer, for counting and displaying the number of bingo numbers called in the set, said counter being reset at the start of each new set;

(e) a random number generator responsive to said timer, for randomly selecting the bingo numbers for each set played, each bingo number having an equal probability of selection; and (f) a means responsive to said random number generator and said timer, for storing and displaying the bingo number called in a set, said means for storing the bingo numbers automatically retaining and outputting upon request from the caller the bingo numbers selected from the previous set, including the last ball called and the number of balls called in the previous set, until the start of the next set, said random number generator, said number counter and said timer cooperating together to select and display bingo numbers until terminated by the caller when a bingo winner is found.

2. The bingo game of claim 1 wherein said random number generator comprises a programmed microprocessor which generates a random seed number for each set played.

3. The bingo game of claims 1 or 2 wherein said variable timer is manually actuated by the caller to determine the rate of bingo numbers called.

4. The bingo game of claims 1 or 2 wherein the predetermined range of said variable timer is within the range of 1 to 99 seconds.

5. The bingo game of claims 1 or 2 wherein the predetermined number of game patterns stored is 30.

6. The bingo game of claims 1 or 2 wherein said number counter includes means for flashing the displayed count number on and off, the displayed count flashed on and off when a predetermined number of balls have been called in a set.

7. The bingo game of claim 6 further including display means for separately displaying the game pattern, game number and bingo numbers for a set to the ball caller and to the game players.

* * * * *